US007028809B2

(12) United States Patent
Dudschus

(10) Patent No.: US 7,028,809 B2
(45) Date of Patent: Apr. 18, 2006

(54) ROOF GRIPPER

(76) Inventor: Dallas Dudschus, 149 Harvard Ave., Fircrest, WA (US) 98466

( * ) Notice: Subject to any disclaimer, the term of this patent is extended or adjusted under 35 U.S.C. 154(b) by 0 days.

(21) Appl. No.: 10/922,145

(22) Filed: Aug. 20, 2004

(65) Prior Publication Data

US 2006/0054399 A1 Mar. 16, 2006

(51) Int. Cl.
*E06C 7/06* (2006.01)
*E04G 1/36* (2006.01)
*E04G 3/08* (2006.01)

(52) U.S. Cl. ..... 182/214; 182/107; 182/45; 248/237; 248/210

(58) Field of Classification Search ..... 182/45, 182/107, 206, 214, 16, 127, 20; 248/210, 248/211, 238, 237
See application file for complete search history.

(56) References Cited

U.S. PATENT DOCUMENTS

| | | | | |
|---|---|---|---|---|
| 1,845,537 | A * | 2/1932 | Wilder | 182/16 |
| 2,597,902 | A * | 5/1952 | Roketa | 182/214 |
| 3,731,947 | A * | 5/1973 | Fontaine | 182/127 |
| 3,954,155 | A * | 5/1976 | Guidara | 182/20 |
| 4,009,762 | A * | 3/1977 | Bjerkgard | 182/20 |
| 4,394,887 | A * | 7/1983 | Spinks | 182/214 |
| 4,938,312 | A * | 7/1990 | Trail | 182/206 |
| 6,681,893 | B1 * | 1/2004 | Coulson | 182/107 |

* cited by examiner

*Primary Examiner*—Hugh B. Thompson, II
(74) *Attorney, Agent, or Firm*—Kenneth S. Kessler

(57) ABSTRACT

A bracing device capable of clamping to a rung ladder is disclosed. The bracing device holds the rung ladder in position when hooked over the peak of a pitched roof. At the forward end of the clamping device are wheels which allow the user to wheel the ladder up the pitched roof.

6 Claims, 3 Drawing Sheets

ROOF GRIPPER

BACKGROUND OF THE INVENTION

Work on roof surfaces always imposes an inherent danger due to the fact that most homes and small buildings utilize pitched roofs. Various methods have been used by roofers to promote safety and provide a means for secure maneuvering. Some of these past methods include the use of ropes secured to stationary objects located above the worker, which are very difficult to access. Such rope systems provide security but restrict movement to relatively small areas.

Other past methods involve the use of wooden planks laid upon the roof surface. Such plank systems require that a base plank be secured at the lower edge of a roof and other planks laid parallel to the base plank as the roofer works his way upward toward the peak of the roof. A plank system requires a substantial number of planks and involves time-consuming transport of the planks plus potential damage to the roof.

The present invention provides for secure footing and a system, which is easily moved along the peak of the roof, enabling the user to work safely at any point on the roof surface.

The present inventor previously invented a ladder-bracing device, which utilized two bracing arms to abut the opposing pitch line of the roof. Further, the bracing device also utilized on adjustable mechanism to adjust the two bracing arms to meet the various angles of pitch on the roofs encountered by the operator. This prior invention, which was used by the inventor and sold to limited other users, did not utilize the following improvements, which are described in this invention:

Wheels positioned at the end of bracing arms;

An efficient mechanism to adjust the bracing arms to meet the varying pitches of roofs;

Utilization of the rungs in order to securely attach the ladder-bracing device to the ladder; and Ability to use the last three feet of the ladder.

The positioning of the wheels at the ends of the bracing arms allows the user to push the ladder to the pitch of the roof on the wheels while the user remains off the roof.

The improvement in adjusting the bracing arms allows for ease in use to meet the varying pitches of roofs, while securing the ladder-bracing device through the rungs provides a strong connection.

DETAILED DESCRIPTION OF THE DRAWINGS

The ladder-bracing device 10 is designed to use the pitch of the roof being worked on to provide the stop for the bracing device 10.

The identical extending bracing arms 22 and 24 are designed to lay flat against the opposing pitch of the roof from where the body of the ladder 16 lays.

The ladder 16 is a conventional ladder with hollow rungs. The ladder 16 provides the user the platform from which he climbs up and down the pitch of the roof and also provides a platform to work from.

Figure 1:
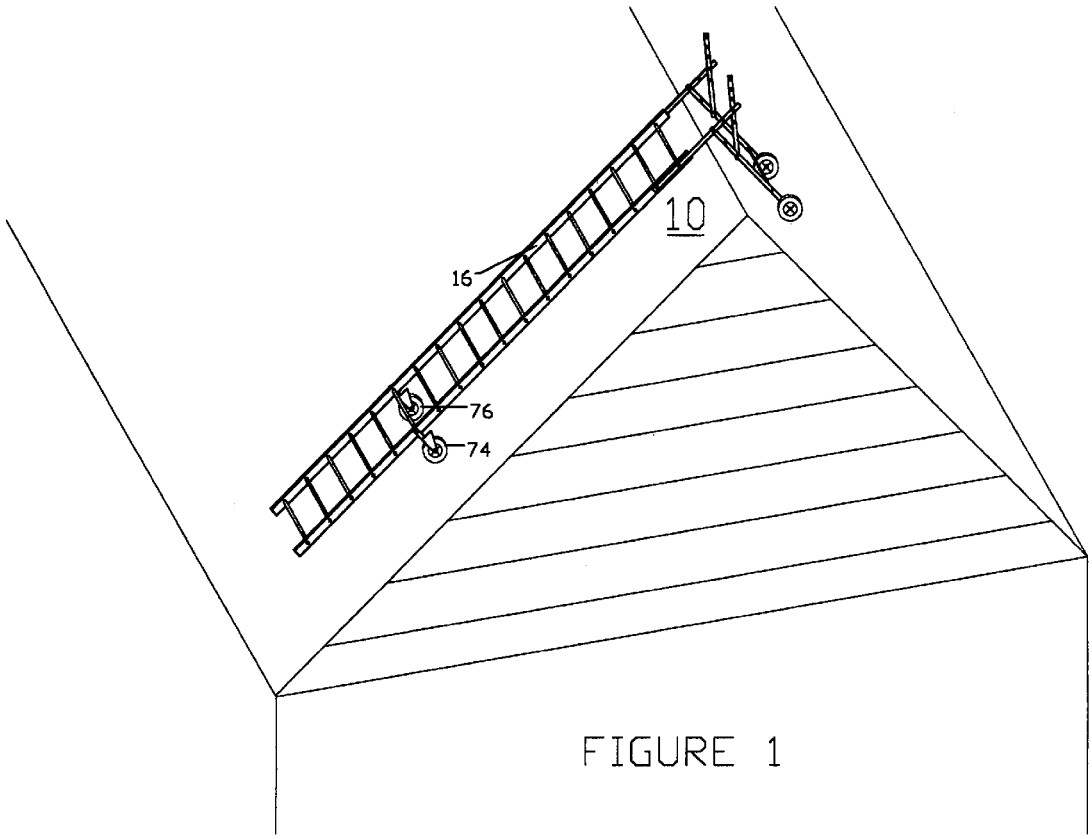
FIG. 1 is a perspective view of the bracing device attached to conventional ladder and positioned over the peak of a roof.

FIG. 1 illustrates the ladder 16 and ladder-bracing device 10 held fast against the pitch of a conventional roof.

Figure 2:
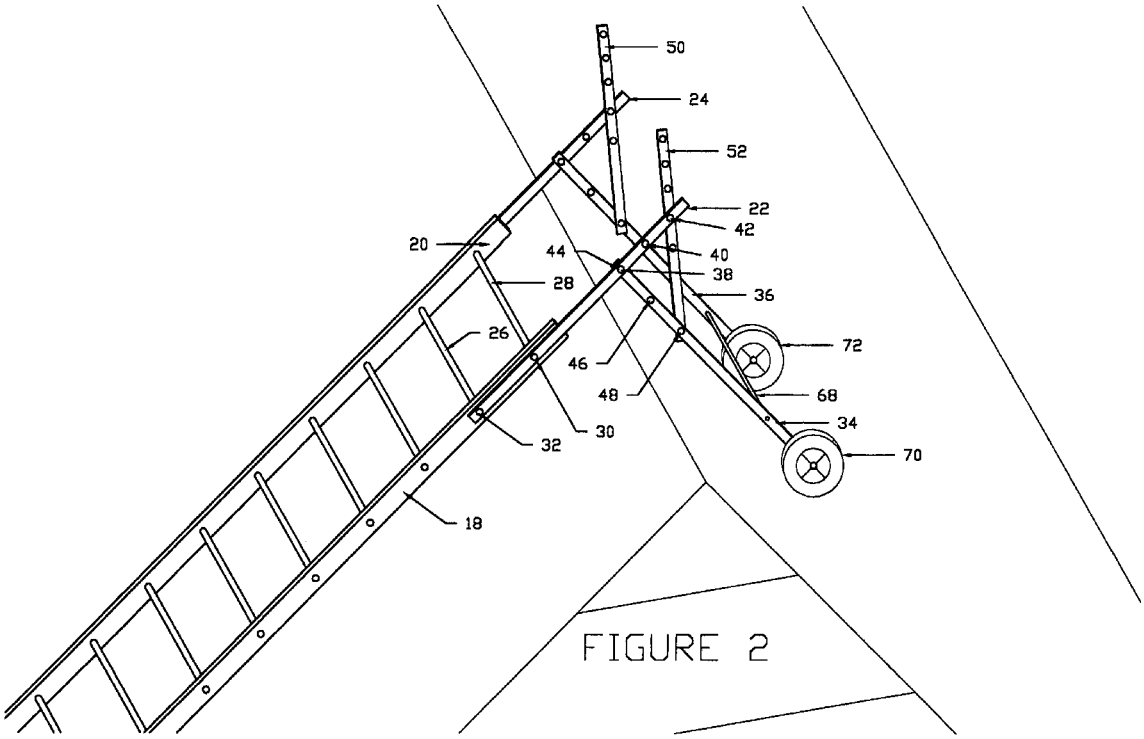
FIG. 2 is side view of the bracing device attached to a conventional ladder.

FIG. 2 is a perspective view of the ladder-bracing device 10 and illustrates that extending from the two sides 18 and 20 of the ladder 16 are extensions arms 22 and 24. The extension arms 22 and 24 are positioned and secured by ladder-rung rods 26 and 28. The ladder-rung rods 26 and 28 pass through two hollow rungs of the ladder 16 and through each extension arm 22 and 24. The rung rods 26 and 28 are secured to the extension arms 22 and 24 by conventional fasteners 30 and 32. With the rung rods in position, the extension arms 22 and 24 extend at the same angle as the sides of the ladder 16.

Attached to the extension arms 22 and 24 are brace arms 34 and 36. The extension arms 22 and 24 utilize a series of holes 38, 40 and 42, which are positioned opposing each other on the extension arms 22 and 24. The brace arms 34 and 36 are attached to the extension arms 22 and 24 through opposing holes 38, 40 or 42 with a shoulder bolt.

Similar to extension arms 22 and 24, brace arms 34 and 36 utilize opposing holes 44, 46 and 48. In the preferred embodiment, holes 44 of the brace arms 34 and 36 are paired with holes of the extension arms 22 and 24 and secured.

Figure 3:
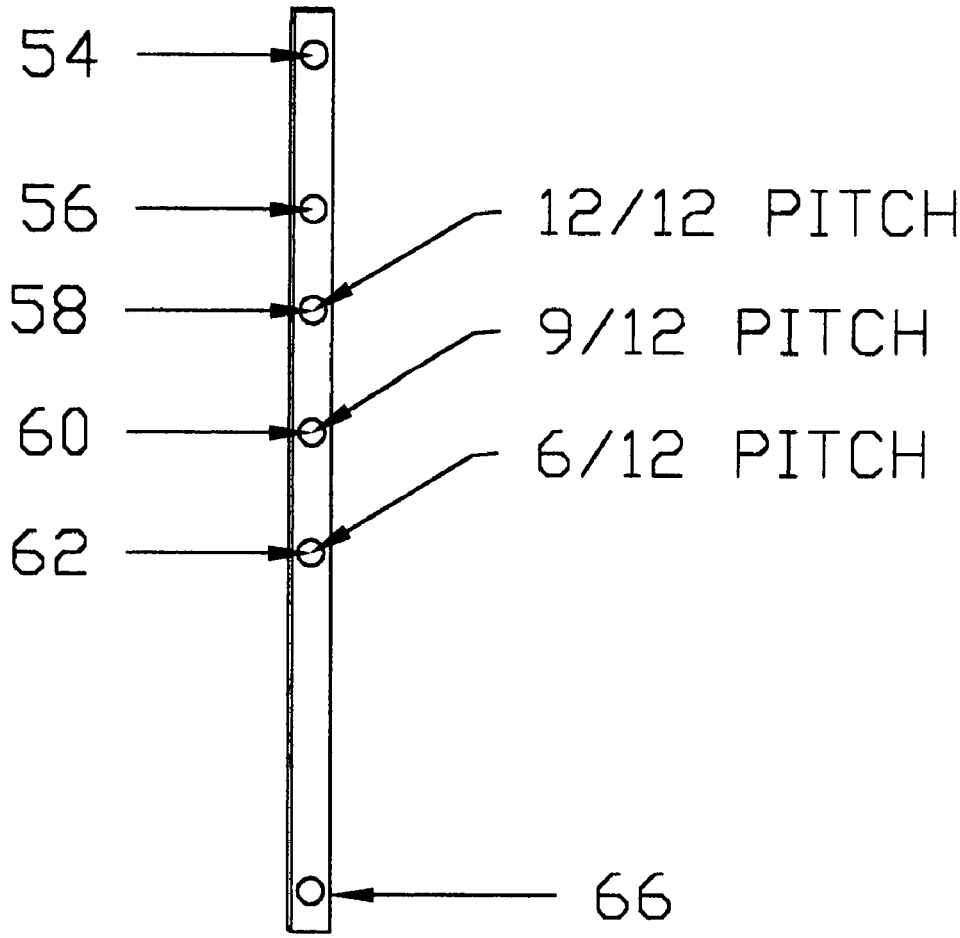
FIG. 3 is a view of the brace arm.

Pitch determination arms 50 and 52 are further attached between the extension arms 22 and 24 and the brace arms 34 and 36. The pitch determination arms 50 and 52 as shown in FIG. 3 utilize a series of holes 54, 56, 58, 60, 62, which, when taken into account with the extension arms and bracing arms, define a series of pitches such as 12/12, 9/12 and so forth. As an example, when a user approaches a 12/12 roof, the user aligns extender arm holes 38 with brace arm holes 44. Pitch determination arms 50 and 52 are aligned with extension arms through hole pairs 42 of the extension arms and so are of the hole pairs 54, 56, 58, 60 or 62 of the pitch determination arms 50 and 52 depending on the desired pitch.

The pitch determination arms are secured through the alignment of hole pairs 66 of the pitch determination arms 50 and 52 and the bracing arms 34 and 36. The pitch determination arms 50 and 52 besides defining pitch, provide further attachment strength between the ladder extension arms 22 and 24 and the bracing arms 34 and 36.

Positioned between the bracing arms 34 and 36 is spreader bar 68.

At the end of the bracing arms 34 and 36 are wheels 70 and 72.

To utilize the invention, the worker first determines the pitch of the roof. Having made this determination, the user affixes the pitch determination arms 50 and 52 to the brace arms and extension arms thereby defining the desired pitch. Next, the user lays the wheels 70 and 72 against the roof and rolls the ladder 16 and ladder-bracing device 10 up the roof and over the roof peak thereby securing the ladder 16 and ladder-bracing device 10 so the user may start working off the ladder rungs.

As set forth in FIG. 1 at the lower end of ladder, swivel wheels 74 and 76 are positioned on either side 18 or 20 of the ladder. Thus, after the ladder is positioned, and the necessary work is done, the user can grab either the extension arms or brace arms and lift. Once lifted, the user can slide the swivel wheels at the lower end of the ladder to a new position.

I claim:

1. A ladder bracing device adapted to a ladder comprising:

a pair of support bars adapted to extend from a ladder;

a means of connecting the support bars to the ladder;

a second pair of support bars capable of attaching at varying angles to the first set of support bars; and a means of connecting the second pair of support bars to the first set of support bars at varying angles.

2. The ladder bracing device of claim 1 wherein the means for connecting the second pair of support bars to the first set of support bars comprises:

a series of opposing holes positioned within the first pair of support bars;

a series of opposing holes positioned within the second pair of support bars;

a pair of arms with a series of opposing holes positioned within the arm pair wherein each arm can be affixed at various positions wherein one arm is positioned with one side of the first and second support bar pairs and the other arm of the arm pair is positioned within the second side of the first and second support bar pair and the series of opposing holes in the first and second support bar pair and opposing arm pair are so positioned to allow the first and second support bar pairs to be set at various angles in relation to each other.

3. The ladder bracing device of claim 2 wherein shoulder bolts connect the support bar pairs and arm pairs.

4. The ladder bracing device of claim 2 wherein affixed to the second pair of support bars are wheels.

5. The ladder bracing device of claim 4 wherein a pair of swivel wheels are attached to one of the lower range of the ladder.

6. The ladder bracing device of claim 5 wherein positioning connection rods are secured through the first pair of extending support bars and the rungs of the ladder.

* * * * *